US010023968B2

(12) United States Patent
Inoue et al.

(10) Patent No.: US 10,023,968 B2
(45) Date of Patent: Jul. 17, 2018

(54) ELECTRIC AL—ZR ALLOY PLATING BATH USING ROOM TEMPERATURE MOLTEN SALT BATH AND PLATING METHOD USING THE SAME

(75) Inventors: Manabu Inoue, Tokyo (JP); Tadahiro Ohnuma, Tokyo (JP); Tsutomu Miyadera, Saitama (JP)

(73) Assignees: Dipsol Chemicals Co., Ltd., Tokyo (JP); Honda Motor Co., Ltd., Tokyo (JP)

( * ) Notice: Subject to any disclaimer, the term of this patent is extended or adjusted under 35 U.S.C. 154(b) by 1648 days.

(21) Appl. No.: 12/526,468

(22) PCT Filed: Feb. 8, 2008

(86) PCT No.: PCT/JP2008/052151

§ 371 (c)(1),
(2), (4) Date: Aug. 7, 2009

(87) PCT Pub. No.: WO2008/096855

PCT Pub. Date: Aug. 14, 2008

(65) Prior Publication Data

US 2010/0285322 A1 Nov. 11, 2010

(30) Foreign Application Priority Data

Feb. 9, 2007 (JP) ..... 2007-30553

(51) Int. Cl.
*C25D 3/66* (2006.01)

(52) U.S. Cl.
CPC ..... *C25D 3/66* (2013.01); *Y10T 428/31678* (2015.04)

(58) Field of Classification Search
CPC ..... C25D 3/66; Y10T 428/31678
See application file for complete search history.

(56) References Cited

U.S. PATENT DOCUMENTS 4,560,446 A 12/1985 Nguyen et al.
4,747,916 A * 5/1988 Kato et al. ..... 205/104

FOREIGN PATENT DOCUMENTS

| | | | | |
|---|---|---|---|---|
| EP | 0 339 536 | A1 | | 11/1989 |
| EP | 0 398 358 | A2 | | 11/1990 |
| EP | 0 404 179 | A1 | | 12/1990 |
| EP | 0 404 188 | A1 | | 12/1990 |
| EP | 0 461 727 | A2 | | 12/1991 |
| JP | 05-051785 | A | | 3/1985 |
| JP | 60-221596 | A | | 11/1985 |
| JP | 62-070592 | A | | 4/1987 |
| JP | 62-070593 | A | | 4/1987 |
| JP | 04-072089 | A | | 3/1992 |
| JP | 05-051785 | A | * | 3/1993 |
| JP | 05-148680 | | * | 6/1993 |

OTHER PUBLICATIONS

"Electrodeposition of Al—Zr Alloys from Lewis Acidic Aluminum Chloride-1-Ethyl-3-methylimidazolium Chloride Melt", Journal of the Electrochemical Society, 2004, 151(7), C447-C454.
Written Opinion of the International Searching Authority.
Extended European search report for EP 08711030.0, dated Jul. 4, 2011.

* cited by examiner

*Primary Examiner* — Kevin R Kruer
(74) *Attorney, Agent, or Firm* — Hoffmann & Baron, LLP

(57) ABSTRACT

Disclosed is an electric Al—Zr alloy plating bath containing an aluminum halide (A), one or more compounds (B) selected from the group consisting of N-alkylpyridinium halides, N-alkylimidazolium halides, N,N'-alkylimidazolium halides, N-alkylpyrazolium halides and N,N'-alkylpyrazolium halides, and a zirconium halide (C). The molar ratio between the aluminum halide (A) and the compounds (B) is from 1:1 to 3:1. The electric Al—Zr alloy plating bath further contains an aromatic organic solvent (D), an organic polymer (E) and one or more additives (F) selected from brightening agents.

3 Claims, No Drawings

ELECTRIC AL—ZR ALLOY PLATING BATH USING ROOM TEMPERATURE MOLTEN SALT BATH AND PLATING METHOD USING THE SAME

CROSS-REFERENCE TO RELATED APPLICATIONS

This application is a National Stage of International Application No. PCT/JP2008/052151, filed Feb. 8, 2008, which claims the benefit of Japanese Application No. 2007-30553, filed Feb. 9, 2007, the contents of all of which are incorporated by reference herein in their entirety.

FIELD OF INVENTION

The present invention relates to an Electric Al—Zr alloy-plating bath which can be used at ordinary temperature. More particularly, the present invention relates to an Electric Al—Zr alloy-plating bath for forming an Electric Al—Zr alloy-plated layer, which can be used as a usual surface treatment for the prevention of the occurrence of any corrosion.

BACKGROUND ART

It has been well-known that an aluminum metal material shows excellent anti-corrosive properties, but aluminum has a strong affinity for oxygen and the reduction potential thereof is inferior to that of hydrogen. For this reason, the electro-deposition of an aluminum layer from an aqueous solution containing the same is quite difficult. Therefore, the electro-plating of aluminum has long been put into practice while using an organic solvent-based plating bath or a high temperature molten salt bath. Typical examples of such organic solvent-based plating baths include those obtained by dissolving $AlCl_3$ and $LiAlH_4$ or LiH in ether; those obtained by dissolving these components in tetrahydrofuran; and solutions of $NaF.2Al(C_2H_5)_3$ in toluene. However, these baths suffer from a problem such that the handling thereof is quite difficult, since it may involve a risk of causing an explosion when it is brought into contact with the air or water. Thus, there has been proposed a mixed molten salt bath comprising an aluminum halide and an alkylpyridinium halide as a bath free of any risk of causing an explosion (see JP-A-62-70592). Moreover, there has also been proposed a molten salt bath comprising an aluminum halide and an alkyl imidazolium halide, which is further blended with a zirconium halide (see Journal of The Electrochemical Society, 2004, 151(7), C447-C454). However, the plating of aluminum from such an Al—Zr alloy plating bath results in the formation of an electro-deposited layer which is non-uniform and insufficient in the smoothness. In particular, when increasing the thickness of the plated layer and/or when increasing the current density, a problem arises such that a dendritic deposit is formed at high current density portions and the deposit thus formed is easily peeled off from the surface of a substrate. Contrary to this, when reducing the current density used, another problem arises such that the throwing power is reduced and this accordingly results in the formation of areas free of any deposit layer. Moreover, if the resulting plated film is subjected to, for instance, the salt spray test without subjecting the film to a chromate-treatment which makes use of chromium (VI)-containing compound, the film is easily dissolved in the salt solution, never ensures the expected anti-corrosive power and accordingly, it would be quite difficult to obtain a highly anti-corrosive Al—Zr alloy-plated film.

SUMMARY OF INVENTION

Accordingly, it is an object of the present invention to provide an Electric Al—Zr alloy-plating bath which never involves any risk of causing an explosion even when it comes in close contact with the air or water, which is never accompanied by the formation of any dendritic deposit at high current density portions, which can ensure the excellent throwing power and form a smooth and uniform plated film even on the low current density area and which can provide a plated film having high corrosion resistance even when the film is not subjected to any chromate-treatment. It is another object of the present invention to provide a highly corrosion-resistant Al—Zr alloy-based rust-proof film which does not contain any chromium.

The present invention has been completed on the basis of such a finding that the improvement of the corrosion resistance and the formation of a uniform film as the subject of the present invention described above can be accomplished and a highly corrosion-resistant Al—Zr alloy-based rust-proofing film can be formed by the incorporation of a specific additive into an electric Al—Zr alloy-plating bath, when an Al—Zr alloy-plated film is formed according to an electro-plating method using the foregoing electric Al—Zr alloy-plating bath which is prepared by mixing (A) an aluminum halide with (B) one or at least two kinds of compounds selected from the group consisting of N-alkylpyridinium halides, N-alkylimidazolium halides, N,N'-alkylimidazolium halides N-alkylpyrazolium halides and N,N'-alkylpyrazolium halides and melting the resulting mixture to give a bath and further incorporating (C) a zirconium halide into the bath. More specifically, the present invention relates to an electric Al—Zr alloy-plating bath which comprises (A) an aluminum halide; (B) one or at least two compounds selected from the group consisting of N-alkylpyridinium halides, N-alkylimidazolium halides, N,N'-alkylimidazolium halides, N-alkylpyrazolium halides and N,N'-alkylpyrazolium halides; and (C) a zirconium halide, wherein the bath comprises the aluminum halide (A) and the compound (B) in a molar ratio ranging from 1:1 to 3:1 and wherein the bath further comprises one or at least two kinds of additives selected from the group consisting of (D) an aromatic organic solvent; (E) one or at least two kinds of organic polymers selected from the group consisting of styrenic polymers and aliphatic diene-derived polymers; and (F) one or at least two kinds of brightening agents selected from the group consisting of aliphatic aldehydes, aromatic aldehydes, aromatic ketones, nitrogen atom-containing unsaturated heterocyclic compounds, hydrazide compounds, sulfur atom-containing heterocyclic compounds, aromatic hydrocarbons each carrying a sulfur atom-containing substituent, aromatic carboxylic acids and derivatives thereof, aliphatic carboxylic acids each having a double bond and derivatives thereof, acetylene alcohol compounds and trifluoro-chloro-ethylenic resins.

The present invention further provides a plating method which makes use of the foregoing electric Al—Zr alloy-plating bath.

The present invention also provides a highly corrosion-resistant Al—Zr alloy film, wherein the rate of co-deposited Zr ranges from 1 to 40% by mass.

The plating bath according to the present invention never involves any risk of causing an explosion and can provide a smooth and fine Al—Zr alloy-plated film over a wide range of current density. Moreover, the resulting film has high resistance to corrosion even when it does not contain any chromium and therefore, it is quite suitable from the viewpoint of the environmental protection and it can thus be used in a wide variety of applications including the plating of parts for motorcars, and the plating of parts for electrical appliances.

DETAILED DESCRIPTION OF INVENTION

The electric Al—Zr alloy-plating bath of the present invention comprises (A) an aluminum halide; (B) one or at least two kinds of compounds selected from the group consisting of N-alkylpyridinium halides, N-alkylimidazolium halides, N,N'-alkylimidazolium halides, N-alkylpyrazolium halides and N,N'-alkylpyrazolium halides; and (C) a zirconium halide, and the bath further comprises one or at least two kinds of additives selected from the group consisting of (D) an aromatic organic solvent; (E) one or at least two kinds of organic polymers selected from the group consisting of styrenic polymers and aliphatic diene-derived polymers; and (F) one or at least two kinds of brightening agents selected from the group consisting of aliphatic aldehydes, aromatic aldehydes, aromatic ketones, nitrogen atom-containing unsaturated heterocyclic compounds, hydrazide compounds, sulfur atom-containing heterocyclic compounds, aromatic hydrocarbons each carrying a sulfur atom-containing substituent, aromatic carboxylic acids and derivatives thereof, aliphatic carboxylic acids each having a double bond and derivatives thereof, acetylene alcohol compounds and trifluoro-chloro-ethylenic resins.

The (A) aluminum halide used in the present invention is represented by the general formula: $AlX_3$, wherein X represents a halogen atom such as a fluorine atom, a chlorine atom, a bromine atom or an iodine atom, with a chlorine or bromine atom being preferably used herein. A chlorine atom is most preferably used herein in the interest of economy.

The N-alkylpyridinium halides used in the present invention as the compound (B) may have an alkyl substituent in the pyridinium backbone and, for example can be represented by the following general formula (I).

(I)

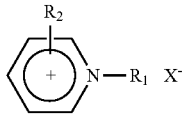

In the formula, $R_1$ represents a linear, branched or cyclic alkyl group having 1 to 12 carbon atoms and preferably a linear or branched alkyl group having 1 to 5 carbon atoms; $R_2$ represents a hydrogen atom or a linear, branched or cyclic alkyl group having 1 to 6 carbon atoms and preferably a linear or branched alkyl group having 1 to 3 carbon atoms; and X represents a halogen atom, with a bromine atom being most preferred as the halogen atom, while taking into consideration the reactivity.

Specific examples of such N-alkyl pyridinium halides include N-methylpyridinium chloride, N-methylpyridinium bromide, N-ethylpyridinium chloride, N-ethylpyridinium bromide, N-butylpyridinium chloride, N-butylpyridinium bromide, N-hexylpyridinium chloride, N-hexylpyridinium bromide, 2-methyl-N-propylpyridinium chloride, 2-methyl-N-propylpyridinium bromide, 3-methyl-N-ethylpyridinium chloride and 3-methyl-N-ethylpyridinium bromide.

The N-alkyl imidazolium halides and N,N'-alkyl imidazolium halides used in the present invention as the compound (B) may be, for instance, represented by the following general formula (II).

(II)

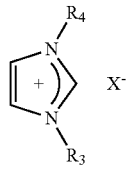

In the formula, $R_3$ represents a linear, branched or cyclic alkyl group having 1 to 12 carbon atoms and preferably a linear or branched alkyl group having 1 to 5 carbon atoms; $R_4$ represents a hydrogen atom or a linear, branched or cyclic alkyl group having 1 to 6 carbon atoms and preferably a hydrogen atom or a linear or branched alkyl group having 1 to 3 carbon atoms; and X represents a halogen atom, with a bromine atom being most preferred as the halogen atom, while taking into consideration the reactivity.

Specific examples of the foregoing N-alkyl imidazolium halides and N,N'-alkyl imidazolium halides include 1-methylimidazolium chloride, 1-methylimidazolium bromide, 1-ethylimidazolium chloride, 1-ethyl imidazolium bromide, 1-propylimidazolium chloride, 1-propylimidazolium bromide, 1-octylimidazolium chloride, 1-octylimidazolium bromide, 1-methyl-3-ethylimidazolium chloride, 1-methyl-3-ethylimidazolium bromide, 1,3-dimethylimidazolium chloride, 1,3-dimethylimidazolium bromide, 1,3-diethylimidazolium chloride, 1,3-diethylimidazolium bromide, 1-methyl-3-propylimidazolium chloride, 1-methyl-3-propylimidazolium bromide, 1-butyl-3-butylimidazolium chloride, and 1-butyl-3-butyl imidazolium bromide.

The N-alkylpyrazolium halides and N,N'-alkylpyrazolium halides used in the present invention as the compound (B) are, for instance, represented by the following general formula (III).

(III)

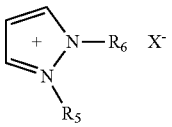

In the formula, $R_5$ represents a linear, branched or cyclic alkyl group having 1 to 12 carbon atoms and preferably a linear or branched alkyl group having 1 to 5 carbon atoms; $R_6$ represents a hydrogen atom or a linear, branched or cyclic alkyl group having 1 to 6 carbon atoms and preferably a hydrogen atom or a linear or branched alkyl group having 1 to 3 carbon atoms; and X represents a halogen atom, with a bromine atom being most preferred as the halogen atom, while taking into consideration the reactivity.

Specific examples of the foregoing N-alkylpyrazolium halides and N,N'-alkylpyrazolium halides include 1-methylpyrazolium chloride, 1-methylpyrazolium bromide, 1-propylpyrazolium chloride, 1-propyl pyrazolium bromide, 1-butylpyrazolium chloride, 1-butylpyrazolium bromide, 1-hexylpyrazolium chloride, 1-hexylpyrazolium bromide, 1-methyl-2-ethylpyrazolium chloride, 1-methyl-2-ethylpyrazolium bromide, 1-methyl-2-propylpyrazolium chloride, 1-methyl-2-propylpyrazolium bromide, 1-propyl-2-methylpyrazolium chloride, 1-propyl-2-methylpyrazolium bromide, 1-butyl-2-methylpyrazolium chloride, 1-butyl-2-methylpyrazolium bromide, 1-hexyl-2-methylpyrazolium chloride, 1-hexyl-2-methylpyrazolium bromide, 1,2-dimethylpyrazolium chloride, 1,2-dimethylpyrazolium bromide, 1,2-diethylpyrazolium chloride and 1,2-diethylpyrazolium bromide.

Moreover, the compound (B) may be a mixture of at least two kinds of compounds selected from the foregoing N-alkylpyridinium halides, N-alkylimidazolium halides, N,N'-alkylimidazolium halides, N-alkylpyrazolium halides and N,N'-alkylpyrazolium halides and further the compound (B) may be a mixture of these compounds whose halogen atoms are different from one another.

In the present invention, the ratio of the molar number of the aluminum halide (A) to that of the compound (B) preferably ranges from 1:1 to 3:1 and more preferably 2:1. The use of these components in such a molar ratio specified above would permit the prevention of the occurrence of any reaction which may be suspected to be the decomposition of pyridinium, imidazolium or pyrazolium cations and likewise permit the prevention of the deterioration of the plating bath and the prevention of the occurrence of any insufficient plating due to the increase in the viscosity of the plating bath.

The zirconium halide (C) used in the present invention is represented by the general formula: $ZrX_4$, wherein X represents a halogen atom such as a fluorine, chlorine, bromine or iodine atom, and preferably chlorine atom in the light of the handleability thereof.

The concentration of the zirconium halide in the bath ranges from 0.1 to 100 g/L, preferably 1 to 50 g/L and more preferably 5 to 20 g/L. The use of the halide in such a bath concentration specified above would permit the control of the rate of co-deposited Zr in the resulting Al—Zr alloy-plated film so as to fall within an appropriate range and likewise permit the prevention of the separation thereof in the form of black powder.

The aromatic organic solvent (D) used in the present invention is a non-aqueous aromatic solvent which is soluble in the molten salt and which does not reduce the electrical conductivity of the molten salt and specific examples thereof are benzene, toluene, xylene, ethyl-benzene, cumene, tetralin, mesitylene, hemimellitene and pseudocumene. Among them, benzene, toluene and xylene are preferable, with toluene being particularly preferred. In addition, the amount of such an aromatic organic solvent to be added to the plating bath is preferably less than 50% by volume, more preferably 1 to 50% by volume and further preferably 5 to 10% by volume. The use of the organic solvent in such an amount specified above would permit the improvement of the throwing power of the resulting plating bath, the formation of a uniform electro-plated layer, and the use thereof never leads to any reduction of the electrical conductivity of the bath or the molten salt and does not increase the risk of catching fire.

Specific examples of the styrenic polymers used as the organic polymers (E) in the electric Al—Zr alloy-plating bath of the present invention are styrenic homopolymers of a styrenic monomer such as styrene, α-methylstyrene, vinyltoluene, and m-methylstyrene, copolymers of these styrenic monomers or copolymers of these styrenic monomers and other polymerizable vinylic monomers. Examples of the foregoing vinylic monomers include maleic anhydride, maleic acid, acrylic acid, methacrylic acid, methyl methacrylate, glycidyl methacrylate, itaconic acid, acrylamide, acrylonitrile, maleimide, vinyl pyridine, vinyl carbazole, acrylic acid esters, methacrylic acid esters, fumaric acid esters, vinyl ethyl ether, and vinyl chloride. Among them, α,β-unsaturated carboxylic acids having 3 to 10 carbon atoms or alkyl (having 1 to 3 carbon atoms) esters thereof are preferable.

In addition, examples of the aliphatic diene-derived polymers used as the organic polymers (E) in the electric Al—Zr alloy-plating bath of the present invention include polymers derived from monomers such as butadiene, isoprene and pentadiene. Among them, polymers each having a branched chain in the form of a 1,2- or 3,4-structure, or copolymers of these monomers with other polymerizable vinylic monomers are preferable. Examples of the foregoing vinylic monomers include those described above in connection with the foregoing styrenic polymers.

The weight average molecular weight of the organic polymer (E) preferably ranges from 200 to 80,000. In particular, polystyrenes and poly(α-methylstyrenes) each having a low to medium weight average molecular weight on the order of 300 to 5,000 are most preferable because of its excellent solubility in the molten salt. The amount thereof to be added preferably ranges from 0.1 to 50 g/L and more preferably 1 to 10 g/L. The use of the organic polymer (E) in such an amount specified above would permit the prevention of the formation of any dendritic deposit, ensure the achievement of the surface-smoothening effect and likewise permit the prevention of the occurrence of any burning of the plated film.

The brightening agent (F) used in the present invention may be, for instance, one or at least two kinds of compounds selected from the group consisting of aliphatic aldehydes, aromatic aldehydes, aromatic ketones, nitrogen atom-containing unsaturated heterocyclic compounds, hydrazide compounds, sulfur atom-containing heterocyclic compounds, aromatic hydrocarbons each carrying a sulfur atom-containing substituent, aromatic carboxylic acids and derivatives thereof, aliphatic carboxylic acids each having a double bond and derivatives thereof, acetylene alcohol compounds and trifluoro-chloro-ethylenic resins.

The aliphatic aldehyde may be, for instance, those having 2 to 12 carbon atoms and specific examples thereof are tribromoacetaldehyde, metaldehyde, 2-ethylhexylaldehyde, and laurylaldehyde.

The aromatic aldehyde may be, for instance, those having 7 to 10 carbon atoms and specific examples thereof are O-carboxybenzaldehyde, benzaldehyde, O-chloro-benzaldehyde, p-tolualdehyde, anisaldehyde, p-dimethylaminobenzaldehyde, and terephthaldehyde.

The aromatic ketones may be, for instance, those having 8 to 14 carbon atoms and specific examples thereof are benzalacetone, benzo phenone, acetophenone and terephthaloyl benzyl chloride.

The nitrogen atom-containing unsaturated heterocyclic compound may be, for instance, those having 3 to 14 carbon atoms and specific examples thereof are pyrimidine, pyrazine, pyridazine, S-triazine, quinoxaline, phthalazine, 1,10-phenanthroline, 1,2,3-benzotriazole, acetoguanamine, cyanuric chloride, and imidazole-4-acrylic acid.

The hydrazide compound may be, for instance, maleic acid hydrazide, isonicotinic acid hydrazide, and phthalic acid hydrazide.

The sulfur atom-containing heterocyclic compound may be, for instance, those having 3 to 14 carbon atoms and specific examples thereof are thiouracil, thionicotinic acid amide, S-trithiane, 2-mercapto-4,6-dimethylpyrimidine.

The aromatic hydrocarbons each carrying a sulfur atom-containing substituent may be, for instance, those having 7 to 20 carbon atoms and specific examples thereof include thiobenzoic acid, thioindigo, thioindoxyl, thioxanthene, thioxanthone, 2-thiocoumarin, thiocresol, thiodiphenyl amine, thionaphthol, thiophenol, thiobenzamide, thiobenzanilide, thio benzaldehyde, thio-naphthene-quinone, thionaphthene, and thioacetanilide.

The aromatic carboxylic acids and derivatives thereof may be, for instance, those having 7 to 15 carbon atoms and specific examples thereof are benzoic acids, terephthalic acid, and ethyl benzoate.

The aliphatic carboxylic acids each having a double bond and derivatives thereof may be, for instance, those having 3 to 12 carbon atoms and specific examples thereof are acrylic acid, crotonic acid, methacrylic acid, acrylic acid-2-ethylhexyl, and methacrylic acid-2-ethylhexyl.

The acetylene alcohol compound may be, for instance, propargyl alcohol.

The fluororesin may be, for instance, trifluoro-chloroethylenic resins each having an average molecular weight ranging from 500 to 1,300.

The amount of the brightening agent (F) to be added to the plating bath preferably ranges from 0.001 to 0.1 mole/L and more preferably 0.002 to 0.02 mole/L. If the brightening agent (F) is used in the plating bath of the present invention in such an amount specified above, the achievement of an intended smoothening effect can be obtained and there is not observed the formation of any black smut-like deposit even when the plating is carried out at a high current density.

In the present invention, one or at least two kinds of such additives as aromatic organic solvents (D), organic polymers (E) and brightening agents (F) are incorporated into the plating bath. All of the aromatic organic solvent (D), the organic polymer (E) and the brightening agent (F) can be incorporated into the plating bath of the invention.

The plating method which makes use of the electric Al—Zr alloy-plating bath according to the present invention is an electro-plating method. The electro-plating method can be carried out using a direct current or a pulsed current, but a pulsed current is particularly preferable. In this connection, it is preferred to use a pulsed current under the following conditions: a duty ratio (ON/OFF ratio) preferably ranging from 1:2 to 2:1 and most preferably 1:1; an ON time ranging from 5 to 20 ms; and an OFF time ranging from 5 to 20 ms, since the electrodeposited particles thus formed are densified and smoothened. The bath temperature used herein usually ranges from 25 to 120° C. and preferably 50 to 80° C. The current density as an electrolysis condition in general ranges from 0.1 to 15 A/dm$^2$ and preferably 0.5 to 5 A/dm$^2$. In this respect, the molten salt plating bath of the present invention is safe even when it is brought into contact with oxygen or water, but the electro-plating method is desirably carried out in a dry, oxygen-free atmosphere (for instance, in a dry nitrogen gas atmosphere or dry air) for the purpose of maintaining the stability of the plating bath and the quality of the resulting plated layer. Moreover, when putting the electric plating into practice, it is desirable that the bath liquid is stirred or/and the subject to be plated is oscillated. For instance, the current density can further be increased by stirring the bath liquid through the use of a jet or ultrasonic waves.

In this respect, however, when plating a part having a complicated shape, it is desirable to omit the stirring operation or weaken the strength of the stirring and to carry out the plating at a low cathode current density of 0.5 to 1 A/dm$^2$ for a long period of time for the improvement of the throwing power. An Al plate and a Zr plate are desirably used as anodes, but an insoluble anode may likewise be used. In this connection, however, it is necessary to maintain the composition of the bath liquid to a desired constant level by the supplementation of an aluminum halide and a zirconium halide.

The rate of the co-deposited Zr in the Al—Zr alloy-plated film obtained using the electric Al—Zr alloy-plating bath of the present invention preferably ranges from 1 to 40% by mass, more preferably 3 to 35% by mass and most preferably 10 to 30% by mass. The use of such a rate of co-deposited Zr would permit the improvement of the corrosion resistance of the resulting Al-plated film.

EXAMPLES

Examples 1 to 9

Toluene as an aromatic organic solvent was blended with a bath prepared by melt blending $AlCl_3$ (841 g/L) and 1-methyl-3-propylimidazolium bromide (64.7 g/L) (at a molar ratio of 2:1) and then zirconium chloride was added to the resulting blend to thus give an electric Al—Zr alloy-plating bath. Then an iron plate (thickness: 0.5 mm) used as a cathode was subjected to pretreatments. More specifically, the iron plate was degreased with an alkali, washed through the alkali-electrolysis, then washed with an acid, washed with water and then with ethyl alcohol and finally dried. Using the foregoing iron plate as a cathode and an aluminum plate (purity 99.9%) as an anode, these electrodes were immersed in the foregoing electric Al—Zr alloy-plating bath maintained at 50° C. in a dry nitrogen gas atmosphere for 5 minutes and then the Al—Zr alloy-plating was carried out using a direct current or a pulsed current (duty ratio=1:1; ON time: 10 ms; and OFF time: 10 ms). In this respect, the plating bath was stirred using a stirrer. In these Examples, the electric plating was carried out while variously changing the added concentrations of zirconium chloride and toluene, and the electrolysis conditions, and the resulting electric Al—Zr alloy-plated films were inspected for the rate of the co-deposited Zr (% the corrosion resistance or the like. The results of such evaluation procedures thus obtained are summarized in the following Table 1.

TABLE 1-1

| Ex. No. | Toluene (% by volume) | $ZrCl_4$ (g/L) | Current Density (A/dm$^2$) | Current | Bath Temp. (° C.) | Time (min) | Zr (%) |
|---|---|---|---|---|---|---|---|
| 1 | 10 | 1 | 4 | Direct Current | 50 | 20 | 5 |
| 2 | 10 | 5 | 4 | Direct Current | 50 | 20 | 20 |
| 3 | 10 | 10 | 4 | Direct Current | 50 | 20 | 25 |
| 4 | 10 | 20 | 4 | Direct Current | 50 | 20 | 30 |
| 5 | 20 | 5 | 2 | Direct Current | 50 | 40 | 20 |
| 6 | 20 | 5 | 6 | Direct Current | 80 | 15 | 20 |
| 7 | 20 | 5 | 1 | Direct Current | 50 | 80 | 25 |
| 8 | 50 | 5 | 0.5 | Direct Current | 50 | 150 | 25 |
| 9 | 10 | 5 | 4 | Pulsed Current | 50 | 40 | 20 |

| Ex. No. | Smoothness of Film, Ra (μm) | Adhesion of Film | Thickness of Film (μm) | Time required for generating red rust on SST (Hr) |
|---|---|---|---|---|
| 1 | 3.0 | Free of any Peeling | 8 | 700 |
| 2 | 1.5 | Free of any Peeling | 8 | 1000 |
| 3 | 1.0 | Free of any Peeling | 8 | 1000 |
| 4 | 1.0 | Free of any Peeling | 8 | 1000 |
| 5 | 2.0 | Free of any Peeling | 8 | 1000 |
| 6 | 2.0 | Free of any Peeling | 8 | 1000 |
| 7 | 1.0 | Free of any Peeling | 8 | 1000 |

TABLE 1-1-continued

| | | | | |
|---|---|---|---|---|
| 8 | 1.0 | Free of any Peeling | 8 | 1000 |
| 9 | 0.8 | Free of any Peeling | 8 | 1000 |

Examples 10 to 15

Zirconium chloride (5 g/L) was added to a bath prepared by melt blending $AlCl_3$ (841 g/L) and 1-methyl-3-propylimidazolium bromide (64.7 g/L) (at a molar ratio of 2:1) and further an organic polymer and a brightening agent were added to the resulting mixture to thus give an electric Al—Zr alloy-plating bath. Then an iron plate (thickness: 0.5 mm) used as a cathode was subjected to pretreatments. More specifically, the iron plate was degreased with an alkali, washed through the alkali-electrolysis, then washed with an acid, washed with water and then with ethyl alcohol and finally dried. Using the foregoing iron plate as a cathode and an aluminum plate (purity 99.9%) as an anode, these electrodes were immersed in the foregoing electric Al—Zr alloy-plating bath maintained at 50° C. in a dry nitrogen gas atmosphere for 5 minutes and then the Al—Zr alloy-plating was carried out using a direct current. In this respect, the plating bath was stirred using a stirrer. In these Examples, the electric plating was carried out while variously changing the kinds and added concentrations of additives and the electrolysis conditions, and the resulting electric Al—Zr alloy-plated films were inspected for the rate of the co-deposited Zr (%), the corrosion resistance or the like. The results of such evaluation procedures thus obtained are summarized in the following Table 2.

TABLE 2

| Ex. No. | Additive (g/L) | Current Density ($A/dm^2$) | Bath Temp. (° C.) | Time (min) |
|---|---|---|---|---|
| 10 | (E) polystyrene[1)] 2.5 g/L | 4 | 50 | 20 |
| 11 | (E) polystyrene[1)] 5 g/L | 2 | 50 | 40 |
| 12 | (F) 1,10-phenanthroline 0.25 g/L | 4 | 50 | 20 |
| 13 | (F) 1,10-phenanthroline 0.5 g/L | 2 | 50 | 40 |
| 14 | (F) isonicotinic acid hydrazide 0.5 g/L | 4 | 50 | 20 |
| 15 | (F) thiouracil 0.2 g/L | 3 | 55 | 25 |

| Ex. No. | Zr (%) | Smoothness of Film, Ra (μm) | Adhesion of Film | Thickness of Film (μm) | Time required for generating red rust on SST (Hr) |
|---|---|---|---|---|---|
| 10 | 20 | 0.8 | Free of any peeling | 8 | 1500 |
| 11 | 20 | 0.7 | Free of any peeling | 8 | 1500 |
| 12 | 20 | 0.4 | Free of any peeling | 8 | 1500 |
| 13 | 20 | 0.3 | Free of any peeling | 8 | 1500 |
| 14 | 20 | 0.8 | Free of any peeling | 8 | 1500 |
| 15 | 20 | 0.8 | Free of any peeling | 8 | 1500 |

[1)]Piccolastic A75 having an MW of 1300 available from Eastman Chemical Company.

Comparative Examples 1 to 3

A bath was prepared by melt blending $AlCl_3$ (841 g/L) and 1-methyl-3-propyl-imidazolium bromide (64.7 g/L) (at a molar ratio of 2:1) and further an organic polymer or a brightening agent was added to the resulting bath to thus give an electric Al—Zr alloy-plating bath. Then an iron plate (thickness: 0.5 mm) used as a cathode was subjected to pretreatments. More specifically, the iron plate was degreased with an alkali, washed through the alkali-electrolysis, then washed with an acid, washed with water and then with ethyl alcohol and finally dried. Using the foregoing iron plate as a cathode and an aluminum plate (purity 99.9%) as an anode, these electrodes were immersed in the foregoing electric Al—Zr alloy-plating bath maintained at 50° C. in a dry nitrogen gas atmosphere for 5 minutes and then the Al alloy-plating was carried out using a direct current. In this respect, the plating bath was stirred using a stirrer. The resulting electric Al—Zr alloy-plated films were inspected for the corrosion resistance or the like. The results of such evaluation procedures thus obtained are summarized in the following Table 3.

TABLE 3

| Comp. Ex. No. | Additive (g/L) | Current Density ($A/dm^2$) | Bath Temp. (° C.) | Time (min) |
|---|---|---|---|---|
| 1 | None | 4 | 50 | 20 |
| 2 | (E) polystyrene[1)] 5 g/L | 4 | 50 | 20 |
| 3 | (F) 1,10-phenanthroline 0.5 g/L | 4 | 50 | 20 |

| Comp. Ex. No. | Smoothness of Film Ra (μm) | Adhesion of Film | Thickness of Film (μm) | Time required for generating red rust on SST (Hr) |
|---|---|---|---|---|
| 1 | 4.0 | Free of any peeling | 8 | 120 |
| 2 | 1.0 | Free of any peeling | 8 | 480 |
| 3 | 0.5 | Free of any peeling | 8 | 480 |

[1)]Piccolastic A75 having an MW of 1300 available from Eastman Chemical Company.

Comparative Examples 4 to 5

Zirconium chloride was added to a bath prepared by melt blending $AlCl_3$ (841 g/L) and 1-methyl-3-propylimidazolium bromide (64.7 g/L) (at a molar ratio of 2:1) to thus give an electric Al—Zr alloy-plating bath, without adding any aromatic organic solvent to the bath. Then an iron plate (thickness: 0.5 mm) used as a cathode was subjected to pretreatments. More specifically, the iron plate was degreased with an alkali, washed through the alkali-electrolysis, then washed with an acid, washed with water and then with ethyl alcohol and finally dried. Using the foregoing iron plate as a cathode and an aluminum plate (purity 99.9%) as an anode, these electrodes were immersed in the foregoing electric Al—Zr alloy-plating bath maintained at 50° C. in a dry nitrogen gas atmosphere for 5 minutes and then the Al—Zr alloy-plating was carried out using a direct current. In this respect, the plating bath was stirred using a stirrer. In these Comparative Examples, the electric plating was carried out while variously changing the electrolysis conditions, and the resulting Al—Zr alloy-plated films were inspected for the rate of the co-deposited Zr (%), the corrosion resistance or the like. The results of such evaluation procedures thus obtained are summarized in the following Table 4.

TABLE 4

| Comp. Ex. No. | Presence of Toluene | $ZrCl_4$ (g/L) | Current Density ($A/dm^2$) | Bath Temp. (° C.) | Time (min) | Zr (%) |
|---|---|---|---|---|---|---|
| 4 | Absent | 5 | 1 | 50 | 80 | 20 |
| 5 | Absent | 5 | 0.5 | 50 | 150 | — |

| Comp. Ex. No. | Smoothness of Film, Ra (μm) | Adhesion of Film | Thickness of Film (μm) | Time required for generating red rust on SST (Hr) |
|---|---|---|---|---|
| 4 | — | Free of peeling | A plated film-free portion is present | 24 |
| 5 | — | — | Free of any plated film | 24 |

(Method for the Determination of Rate of Co-Deposited Zr (%) and Thickness of Plated Film)

The rate of the co-deposited Zr (%) and the thickness of the resulting Al—Zr alloy-plated film were determined using an X-ray fluorescence spectrometer (Micro-Element Monitor SEA5120 available from SII-Nanotechnology Co., Ltd.).

(Method for the Determination of Time Required for Generating Red Rust on SST)

The time required for the generation of red rust on SST was determined according to the salt spray test (JIS Z2371).

(Method for the Determination of Smoothness)

The smoothness of the resulting plated film was determined using a surface roughness-measuring device (Surf-Coder SE-30H available from KOSAKA Laboratory Co., Ltd.).

(Method for Determining Adhesion)

The adhesion of the resulting plated film was evaluated according to the tape-peeling test. The tape-peeling test was carried out by bending a substrate at an angle of 180 degs. with the surface carrying the alloy-plated film inside, then returning the substrate to the original state, adhering an adhesive cellophane tape (having a width of 18 mm and specified in JIS Z1522) to the bent portion of the substrate while pressing the same against the substrate with an eraser (specified in JIS S6050), thereafter instantaneously peeling the tape by pulling one end thereof maintained at a right angle to the adhered surface within 90 seconds from the application of the tape to the substrate and visually observing the film and judging whether the film was peeled off or not.

What is claimed is:

1. An electric Al—Zr alloy-plating bath which comprises (A) an aluminum halide;

(B) one or at least two kinds of compounds selected from the group consisting of N-alkylimidazolium halides, N,N'-alkylimidazolium halides, N-alkylpyrazolium halides and N,N'-alkylpyrazolium halides;

(C) a zirconium halide; and (D) an aromatic organic solvent selected from the group consisting of benzene, toluene, xylene and combinations thereof, wherein the bath comprises the aluminum halide (A) and the compound (B) in a molar ratio ranging from 1:1 to 3:1, and wherein the amount of (C) zirconium halide is 5-20 g/L, and the amount of (D) aromatic organic solvent is 5-10% by volume.

2. An electric plating method utilizing the electric Al—Zr alloy-plating bath as set forth in claim 1.

3. The electric plating method as set forth in claim 2, wherein the electric plating is carried out using a pulsed current.

* * * * *